United States Patent [19]

Van Vuren

[11] Patent Number: 4,758,190

[45] Date of Patent: Jul. 19, 1988

[54] DRAIN SYSTEM FOR OUTBOARD MOTOR COWLING

[75] Inventor: Henry J. Van Vuren, Redgranite, Wis.

[73] Assignee: Brunswick Corporation, Skokie, Ill.

[21] Appl. No.: 79,025

[22] Filed: Jul. 29, 1987

[51] Int. Cl.[4] ..... B63H 1/00

[52] U.S. Cl. ..... 440/88; 440/77; 440/900

[58] Field of Search ..... 440/77, 76, 87, 88, 440/89, 900, 113; 114/197, 198, 211, 212

[56] References Cited

U.S. PATENT DOCUMENTS 4,461,250 7/1984 Mohr ..... 440/88

4,678,441 7/1987 Murase ..... 440/88

*Primary Examiner*—Sherman D. Basinger

*Assistant Examiner*—Edwin L. Swinehart

*Attorney, Agent, or Firm*—Andrus, Sceales, Starke & Sawall

[57] ABSTRACT

A drain assembly for draining water from the engine compartment of an outboard motor. The drain assembly includes a valve member actuatable in response to movement of the throttle control mechanism to an open position to permit water to drain from within the engine compartment through an aperture in a bottom wall portion of the engine cowling when the throttle control mechanism is moved to its full throttle position. The valve member is biased to a closed position by a spring and is moved to its closed position to prevent ingress of water into the engine compartment through the aperture in the bottom wall of the engine cowling when the throttle control mechanism is moved to a less than full throttle position.

7 Claims, 2 Drawing Sheets

FIG. 1
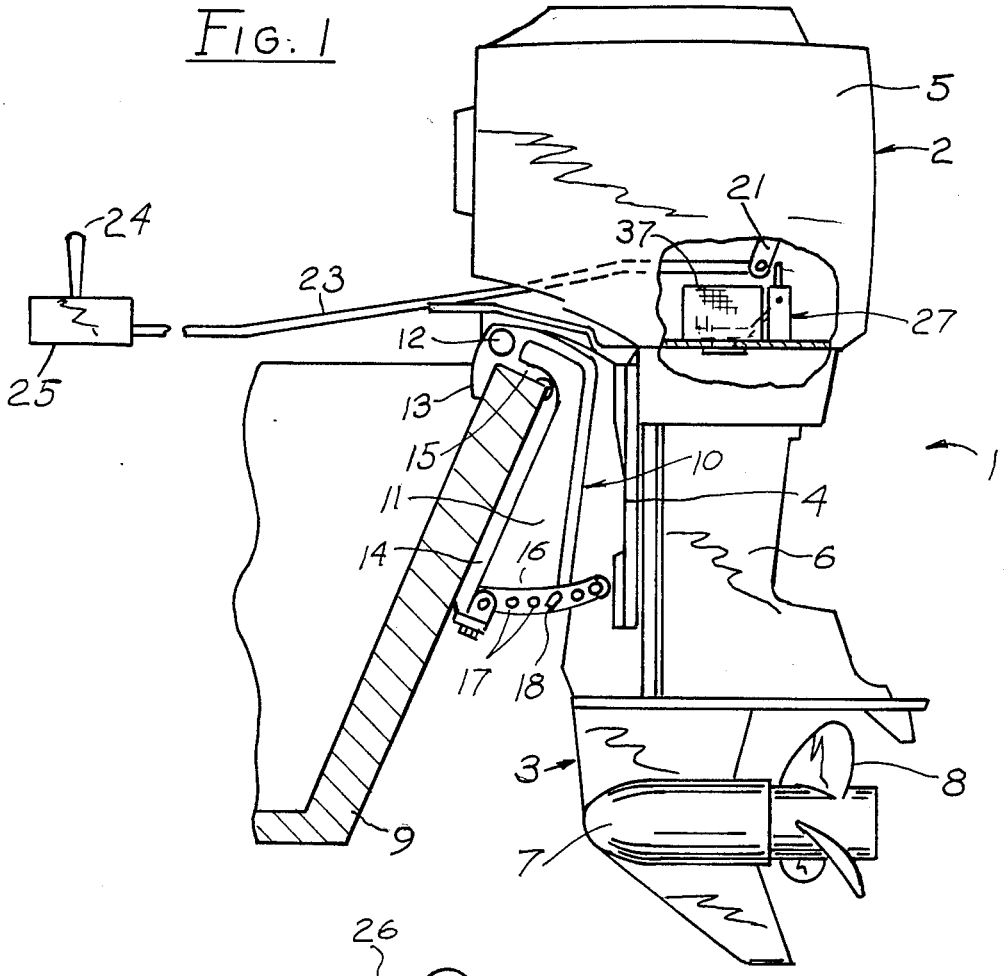
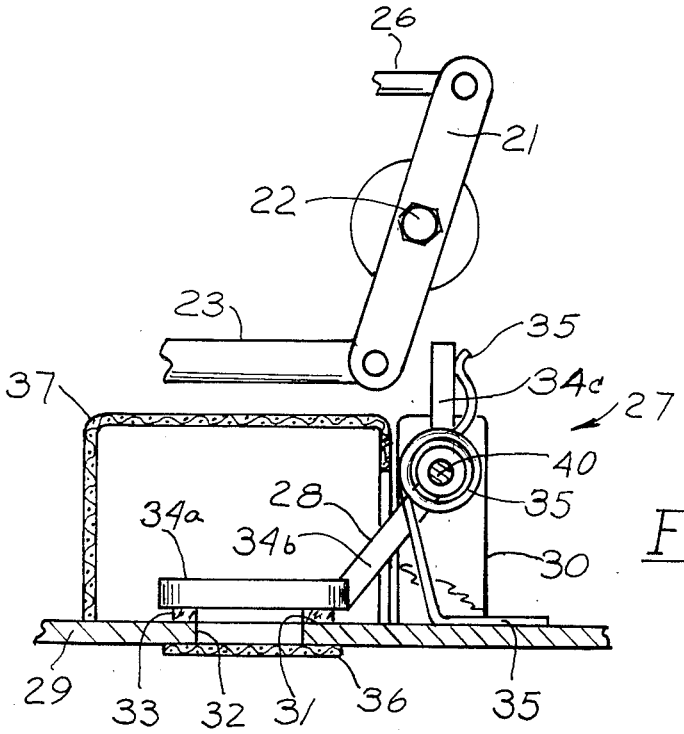
FIG. 2

DRAIN SYSTEM FOR OUTBOARD MOTOR COWLING

BACKGROUND OF THE INVENTION

The present invention relates to marine propulsion drives, and more particularly to a drain assembly for draining water from the engine compartment of an outboard motor.

Outboard motors typically include a power head housing or cowling defining an engine compartment for an internal combustion engine. The motor cowling oftentimes becomes partially submerged for a short time as, for example, when the boat comes down off plane, when the boat is launched from a trailer, or during heavy wave conditions. When the motor cowling becomes partially or totally submerged, water may enter the engine compartment and accummulate at the bottom wall of the motor cowling. Thus, it would be desirable to provide a device which would drain any accummulated water from the motor cowling while not allowing ingress of water into the engine compartment should the motor cowling become partially or totally submerged. This is especially desirable for outboard motors carried out behind a boat wholly aft of the boat transom since the motor cowlings of these outboard motors usually are somewhat closer to the water than those mounted directly on the boat transom.

Various types of drain assemblies for outboard motors are known, and attention is directed to the following U.S. patents relating to such arrangements:

| U.S. Pat. No. | Inventor | Issue Date |
|---|---|---|
| 4,403,972 | Bland et al | Sept. 13, 1983 |
| 4,518,363 | Bland et al | May 21, 1985 |
| 4,533,331 | Bland | Aug. 6, 1985 |

SUMMARY OF THE INVENTION

A drain assembly for draining water from the engine compartment of a marine propulsion drive. The drain assembly includes valve means actuatable in response to movement of a throttle control mechanism for the engine between an open position which permits water to drain from within the engine compartment through an aperture in the engine cowling when the throttle control mechanism is moved to its full throttle position, and a closed position to prevent ingress of water into the engine compartment through the aperture in the engine cowling when the throttle control mechanism is moved to a less than full throttle position.

The valve means preferably comprises a pivotable valve member having a gasket member movable into and out of sealing engagement with a valve seat in the bottom wall of the engine cowling, and a spring means for biasing the valve member to its closed position.

In one embodiment, the throttle control mechanism acts directly against a throttle engaging portion of the valve member which is located in the path of movement of the throttle control mechanism. In another embodiment, the throttle control mechanism acts indirectly against the valve member by moving a linkage member which in turn engages the throttle engaging portion of the valve member. Additionally, a screen may be disposed over the aperture in the engine cowling for preventing debris from entering the engine compartment and/or inhibiting the operation of the valve member.

The present invention thus provides a drain assembly for draining water from the engine compartment of an outboard motor while not allowing water to return if the motor is partially or totally submerged. Other features and advantages of the invention will become apparent to those skilled in the art upon reviewing the following detailed description, the drawings, and the appended claims.

BRIEF DESCRIPTION OF THE DRAWINGS

The drawings illustrate the best mode presently contemplated of carrying out the invention.

In the drawings:

FIG. 1 is a side view in elevation with parts broken away illustrating an outboard motor mounted on a boat transom which incorporates a drain valve assembly in accordance with the present invention;

FIG. 2 is an enlarged side view in elevation of the drain valve assembly illustrating the valve member in its closed position and a throttle arm in a less than full throttle position;

DESCRIPTION OF THE PREFERRED EMBODIMENTS

Figure 3:
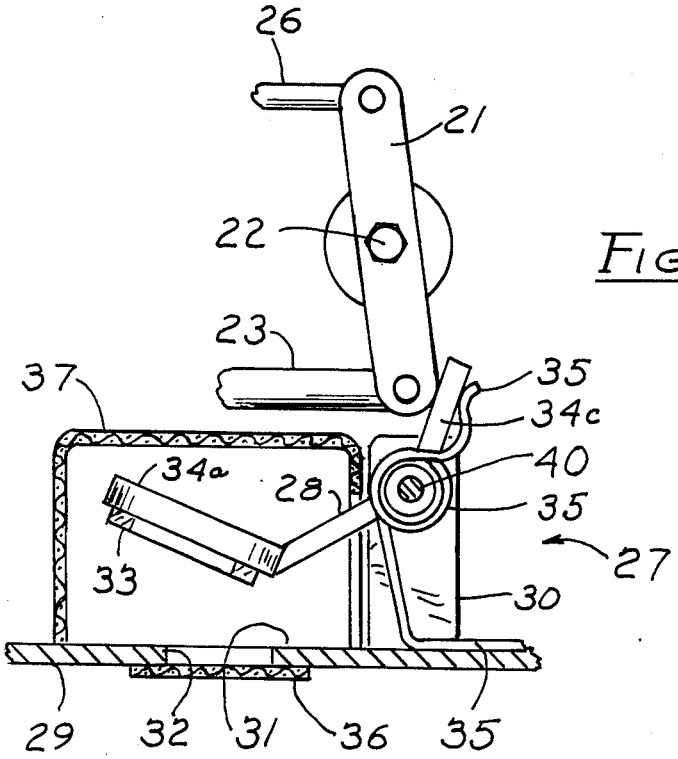
FIG. 3 is a view similar to FIG. 2 illustrating the valve member in its open position with the throttle arm in its full throttle position.

Referring now to the drawings, FIG. 1 illustrates a marine propulsion drive in the form of an outboard motor 1 having a propulsion assembly including an upper unit or powerhead 2, a lower unit 3 and a swivel bracket 4. Upper unit 2 includes a cover or cowl 5 defining an engine compartment for housing an internal combustion engine (not shown).

Lower unit 3 is rigidly mounted to the bottom of the powerhead or upper unit 2 and includes a drive shaft housing 6 and a gear case 7. The gear case 7 is normally submerged in water and supports a rotatable propeller shaft carrying a propeller 8. Gear case 7 houses a suitable reversing transmission which drivingly connects propeller 8 to a drive shaft extending through the drive shaft housing 6 which drivingly interconnects the engine and propeller 8.

Lower unit 3 is connected to swivel bracket 4 for swivel or swinging movement about a vertical axis and in a horizontal plane to provide steering control of motor 1.

Outboard motor 1 is supported from a transom 9 or other supporting member of a boat hull by a mounting assembly comprising a transom bracket 10 on which swivel bracket 4 is mounted. Outboard motor 1 including swivel bracket 4 is connected to transom bracket 10 for pivotal or tilting movement about a horizontal transverse axis and in a vertical plane between and operating position wherein gear case 7 and propeller 8 are fully submerged in water, and a tilted or non-operating position wherein gear case 7 and propeller 8 are raised from the water, as for trailering.

Transom bracket 10 includes two spaced apart inverted U-shaped clamp members or mounting members 11 (only one of which is shown) for removably mounting outboard motor 1 to transom 9. Clamp members 11 are interconnected by a pivot pin or tilt shaft 12 which extends substantially horizontally between the upper ends of clamp members 11. Each inverted U-shaped clamp member 11 has an upper body portion with an integral inside leg 13, an outside leg 14 extending downwardly therefrom and defining a transom receiving opening 15 therebetween. Outside leg 14 has an inner bearing surface for bearing engagement against the outside surface of transom 9 when clamp members 11 are clamped together thereon. Each outside leg 14 also has a rearwardly extending arm 16 thereon with spaced holes 17 therein. A tilt pin 18 is carried through the proper holes 17 to provide an abutment means for swivel bracket 14 resulting in proper trim for motor 1 during operation. Transom receiving opening 15 may be of any desired width sufficient to enable the engine to be readily installed over transoms of any thickness within a desired range.

FIG. 1 also illustrates a throttle control mechanism selectively movable between a full throttle position and a less than full throttle position to control the amount of fuel fed to the engine. The throttle control mechanism includes a throttle arm 21 pivotally supported on the cylinder block of the engine by a screw 22. The lower end of throttle arm 21 is connected by a cable 23 to a throttle control lever 24 operably disposed within a control box 25 provided remotely from outboard motor 1 to control the functions with respect to throttle advance of the engine for outboard motor 1. The upper end of throttle arm 21 has one end of a link 26 connected thereto. Link 26 has its other end operatively associated with a throttle actuator cam (not shown) and carburetor valve (not shown) in any conventional manner such as, for example, the arrangement shown in U.S. Pat. No. 3,769,949. Accordingly, when throttle arm 21 is pivoted about the axis of screw 15 the carburetor valve either increases the fuel/air mixture supplied to the engine whereby the engine speed is increased or descreases the fuel air mixture supplied to the engine whereby the engine speed is decreased.

As shown best in FIGS. 2 and 3, a drain valve assembly generally designated by the numeral 27 is operatively associated with throttle arm 21 and disposed in the path of movement thereof for draining water from the engine compartment within motor cowling 5 during operation of the boat when throttle arm 21 is moved to its full throttle position while also preventing ingress of water into the engine compartment when the throttle arm 21 is moved to a less than full throttle position. Drain valve assembly 27 includes a valve member 28 pivotally mounted on bottom wall 29 of cowling 5 as by pin 40 and bracket 30. Bottom wall 29 provides an annular valve seat 31 disposed about an aperture 32 therein, and valve member 28 includes an annular gasket member 33 on its lower surface which is disposed in sealing engagement with valve seat 31 when valve member 28 is in its closed position. Valve member 28 includes a flat disk-shaped portion **34*a*, an arm portion 34*b* extending between the periphery of portion 34*a* and pivot pin 40, and an integral throttle engaging portion 34*c* projecting from the end of portion 34*b* and located so that its outer end lies adjacent throttle arm 21 and in the path of movement thereof. A spring 35 biases valve member 28 to its closed position. A flat screen 36 is disposed over aperture 32 on the outside of bottom wall 29 of cowling 5 to prevent debris from entering the engine compartment. A second box-like screen 37 may also be employed to cover aperture 32 on the inside of bottom wall 29 of cowling 5** to further aid in preventing debris from fouling the valve assembly if necessary.

In operation, and as shown in FIG. 2, when throttle arm 21 is moved to a less than full throttle position spring 35 forces gasket 33 to be in sealing engagement with valve seat 31 so that water is prevented from entering through aperture 32 into the engine compartment inside cowl 5. Thus, should the upper unit 2 of outboard motor 1 become partially or totally submerged for a short time as the boat comes down off plane or when the boat is launched from a trailer, drain valve assembly 27 prevents water from entering the engine compartment.

However, as best shown in FIG. 3, when throttle arm 21 is moved to its full throttle position by cable 23 the lower end of throttle arm 21 engages portion **34*c* of valve member 28 and pivots valve member 28 to an open position against the force of spring 35. Once gasket 33 unseats from valve seat 31 any accummulated water within cowling 5 will be trained through aperture 32, since aperture 32 is located at a low point in bottom wall 29 of cowling 5. When throttle arm 21 is pivoted in the reverse direction to reduce engine speed and thus moved to a less than full throttle position, as shown in FIG. 2, valve member 28 will once again pivot to its closed position by the force of spring 35, as shown in FIG. 2**.

Figure 4:
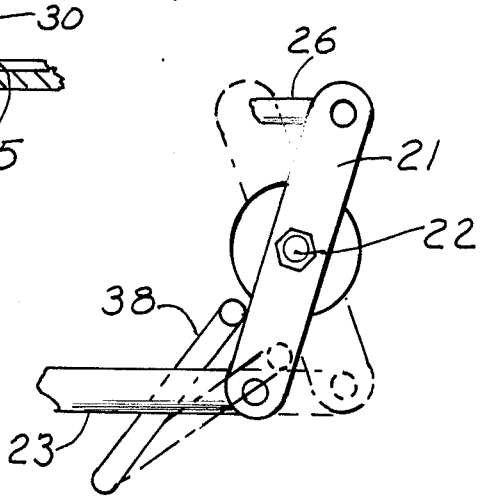
FIG. 4 is a view similar to FIG. 2 of a second embodiment of the drain valve assembly illustrating a throttle arm in its full throttle position engaging an intermediate linkage assembly.
Figure 5:
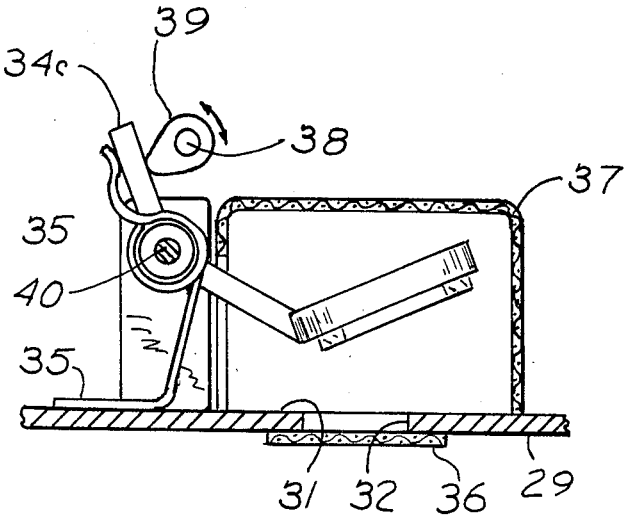
FIG. 5 is a side view in elevation of the second embodiment of the drain valve assembly with its valve member known in its open position.

Referring now to FIGS. 4 and 5, there is shown a second embodiment of the drain valve assembly of the present invention. In this embodiment, the throttle control mechanism and drain valve assemblies described with respect to FIGS. 2 and 3 are identical as hereinbefore illustrated and described. However, the drain valve assembly is located on the opposite side of the engine from that shown in FIG. 1, and instead of the lower end of throttle arm 21 acting directly against portion **34*c* of valve member 28, in this embodiment the lower end of throttle arm 21 acts against an intermediate linkage assembly comprising link 38 pivotally mounted on the cylinder block of the engine. One end of link 38 is in the form of a crank arm so that when throttle arm 21 is moved to its full throttle position its lower end acts against the crank end of link 38 to longitudinally turn or pivot link 38 so that a projection or cam member 39 (FIG. 5) located on the opposite end of link 38 engages portion 34*c* of valve member 28 to pivot valve member 28 to its open position. Likewise, when throttle arm 21 is moved to a less than full throttle position link 38 turns or pivots in the opposite direction thus permitting valve member 28 to once again seat itself in its closed position to prevent ingress of water into cowling 5**.

A drain valve assembly has been illustrated and described for use with a marine propulsion drive in the form of an outboard motor. In one embodiment, the drain valve assembly may be actuated in response to the movement of the throttle control mechanism by direct engagement therewith, and in a second embodiment the drain valve assembly may be actuated indirectly in response to movement of the throttle control mechanism through a linkage assembly. Thus, the location of the drain valve assembly may be varied depending upon the particular cowling design and space limitations of different outboard motors. Additionally, other components specifically illustrated an described herein may be varied and/or substituted without departing from the scope of the present invention. For example, various types of throttle control mechanisms and linkage assemblies may be utilized as desired.

Various modes of carrying out the invention are contemplated as being within the scope of the following claims particularly pointing out and distinctly claiming the subject matter which is regarded as the invention.

I claim:

1. A marine propulsion drive including an upper unit having a cowling defining an engine compartment for housing an internal combustion engine, said cowling having a bottom wall portion with an aperture therein, a lower unit carrying a propeller and having a driveshaft for drivingly interconnecting the engine and propeller, a throttle control mechanism selectively movable between a full throttle position and a less than full throttle position, and a drain assembly for draining water from the engine compartment, said drain assembly comprising valve means actuatable in response to movement of the throttle control mechanism between an open position to permit water to drain from within the engine compartment through said aperture when said throttle control mechanism is moved to its full throttle position and a closed position to prevent ingress of water into said engine compartment through said aperture when said throttle control mechanism is moved to its less than full throttle position.

2. The marine propulsion drive of claim 1 wherein said valve means comprises a pivotally mounted valve member.

3. The marine propulsion drive of claim 2 further including means for biasing said valve member to its closed position.

4. The marine propulsion drive of claim 3 wherein said bottom wall includes a valve seat and said valve member includes a gasket member in sealing engagement with said valve seat when said valve member is in its closed position.

5. The marine propulsion drive of claim 1 wherein said throttle control mechanism includes a pivotable throttle arm and said valve means includes a throttle-engaging portion located adjacent said throttle arm and in the path of movement thereof.

6. The marine propulsion drive of claim 1 wherein said throttle control mechanism includes a pivotable throttle arm and a movable linkage member operatively associated with said throttle arm, and said valve means includes a throttle-engaging portion located adjacent said linkage member and in the path of movement thereof.

7. The marine propulsion drive of claim 1 further including a screen disposed over said aperture for preventing debris from fouling said valve means.

* * * * *